United States Patent [19]

Oldorf

[11] Patent Number: 4,767,022

[45] Date of Patent: Aug. 30, 1988

[54] PACKET DISPENSER

[76] Inventor: Dennis Oldorf, P.O. Box 1883, Cedar Rapids, Iowa 52406

[21] Appl. No.: 925,355

[22] Filed: Oct. 31, 1986

[51] Int. Cl.[4] ..... B65H 1/00

[52] U.S. Cl. ..... 221/92; 221/191; 221/197; 221/281; 221/282; 221/283; 221/287; 221/305; 221/312 R; 229/122; 229/23 BT; 229/20; 229/11; 312/42

[58] Field of Search ..... 221/197, 198, 194, 191, 221/92, 155, 282, 286, 287, 303, 312 R, 311, 307, 309, 199, 281, 302, 312 A, 312 B, 312 C, 305, 283; 312/35, 42, 259–261, 119, 122, 126, 127; 211/59.2, 49.1, 71; 229/17 B, 19, 20, 11, 9, 7 R, 17 R, 122, 120.02, 23 BT; 248/146, 205.3, 205.2

[56] References Cited

U.S. PATENT DOCUMENTS

| | | | |
|---|---|---|---|
| 536,544 | 3/1895 | Schmidt . | |
| 1,673,711 | 6/1928 | Richeson | 312/42 |
| 1,972,406 | 9/1934 | Marsh | 221/155 X |
| 1,974,926 | 9/1934 | Marsh | 221/197 X |
| 1,999,021 | 4/1935 | Marsh | 221/92 |
| 2,785,843 | 3/1957 | Shaw | 229/17 B |
| 3,164,298 | 1/1965 | Repko | 221/303 |
| 3,309,206 | 3/1967 | Daniels . | |
| 3,568,911 | 3/1971 | Bebout . | |
| 4,170,325 | 10/1979 | Pawlowski | 229/17 B |
| 4,199,078 | 4/1980 | Ramirez | 221/309 |
| 4,382,526 | 5/1983 | Stone | 221/34 |
| 4,497,432 | 2/1985 | Milia | 229/17 B |

FOREIGN PATENT DOCUMENTS

| | | | |
|---|---|---|---|
| 101042 | 2/1965 | Denmark | 248/205.2 |
| 387473 | 5/1965 | Switzerland | 248/205.2 |
| 1036718 | 7/1966 | United Kingdom | 221/311 |

*Primary Examiner*—Joseph J. Rolla
*Assistant Examiner*—David H. Bollinger
*Attorney, Agent, or Firm*—Allan L. Harms

[57] ABSTRACT

A dispensing apparatus for relatively flat packets such as individually packaged non-prescription drugs is disclosed. A housing having openings in the top and front walls thereof receives a plurality of vertically disposed magazines. The magazines each comprise a packet receiving tray member and a removable sleeve which partly encloses the tray member. An opening in the magazine is provided by the cooperation of an opening in a wall of the sleeve and the tray member. A liner is disposed in the tray member depending from the wall of the tray member and engaging the inner rear wall of the tray member. A shelf depends from the magazine opening at the lower end of the opening. An optional laterally disposed extension is provided at the bottom of the housing.

16 Claims, 1 Drawing Sheet

FIG 1
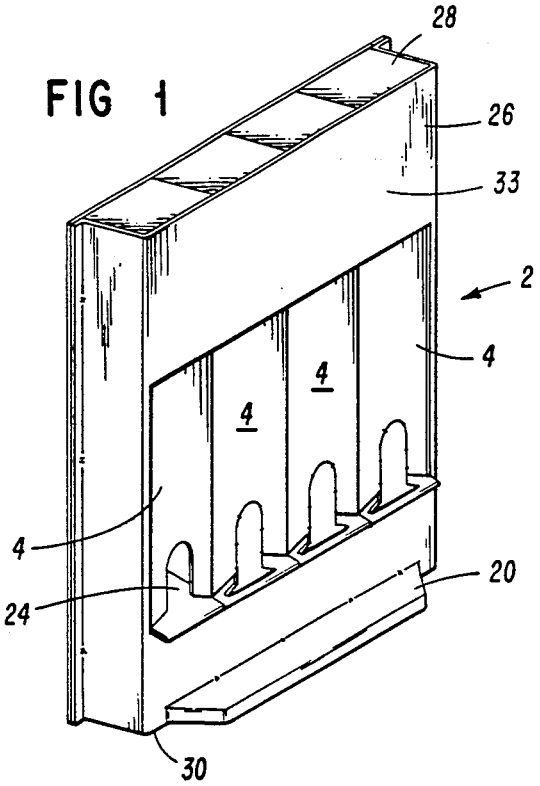
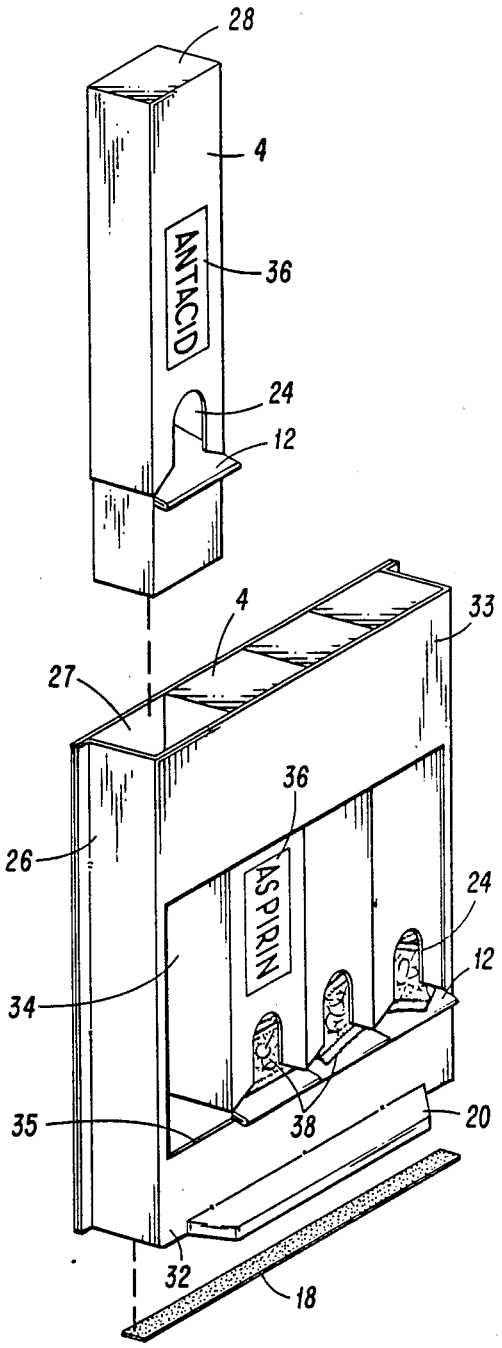
FIG 2
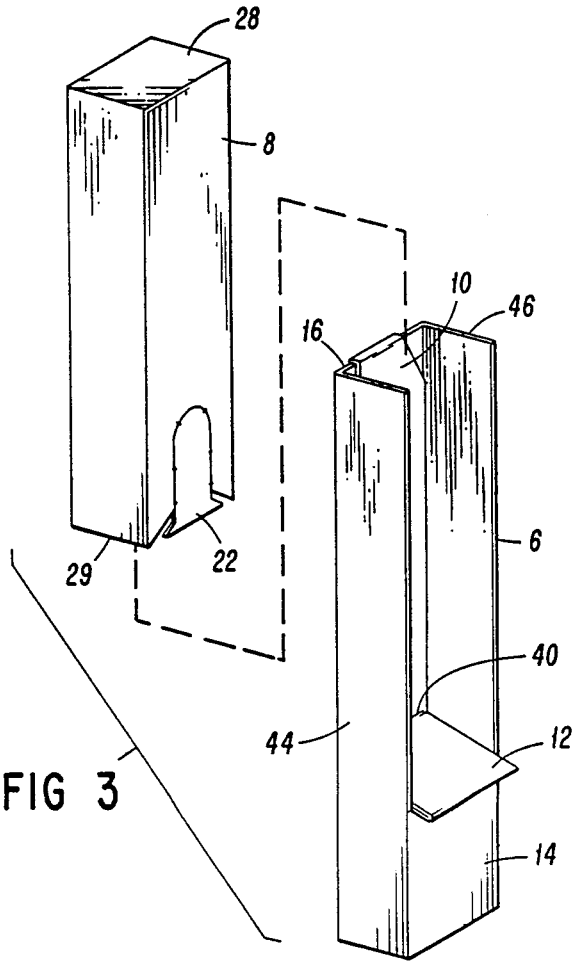
FIG 3

PACKET DISPENSER

BACKGROUND OF THE INVENTION

This invention relates to storing and dispensing receptacles for relatively flat articles.

In the packaging of over the counter medication such as aspirin, antacids and the like, it has become commonplace to package a single dosage of one or two capsules or tablets in an individually wrapped packet. Such packets are then typically fastened to a display board which is placed in a convenient location so that the consumer or retailer may easily remove a single packet for use by the consumer. When replenishment is necessary the use of display boards requires either re-application of packets by staples or other means to the board once the supply has been depleted. Frequently more than one type of non-presciption medication is provided on the display board and a first brand or type of medication may be depleted before the remaining brands or types of medications are sold. This leads to either a restock of the display by stapling or other fastening of packets to the display or else the display card remains in place without a full complement of products for sale.

The use of a packet dispenser assists in obviating some of these problems. Those dispensers currently known in the art fail to provide satisfactory features for the dispensing of individual packages of over the counter medication and the easy restock thereof while at the same time providing a receptacle which effectively communicates the contents to the consumer. A dispenser such as U.S. Pat. No. 4,170,325 provides a carton which dispenses uniformly shaped packets (such as tea bags in pouches) through a front opening. The packets must be inserted in the carton such that the rear edges of the packets engage the rear wall of the carton below the engagement of the front edges of the packets with the front wall. The carton is therefore dependent in configuration to the packet to be dispensed. The engagement of the front and rear edges of the generally horizontally disposed packets with the front and rear walls of the carton is critical to successful operation of this carton.

The container of U.S. Pat. No. 4,382,526 requires that the packets be inserted in the carton in a substantially uniformly arranged stack in a generally horizontal fashion. This container would not provide appropriate front wall dispensing of a jumbled cluster of packets as such packets would tend to tumble freely from the container. In addition, such a container is dependent generally on the shape and side of a packet to be dispensed.

The container of U.S. Pat. No. 3,568,911 provides a side by side arrangement of gravity fed bins from which the packet may be lifted by the consumer. In this device, paired or single bins are provided from a single blank which is appropriately folded into the carton configuration. Removal of one of a bin pair cannot be made and therefore, any permanent labeling of the bins will restrict the product to be dispensed therein.

The instant invention provides improvements over these prior devices to solve the problems indentified.

SUMMARY OF THE INVENTION

Individually wrapped tablets or capsules of non-prescription medications are only generally uniform in shape. The position of the tablets or capsules within the packets is subject to variation and therefore packet thickness will vary greatly. Additionally, the stiffness and size of the packaging of the packets will vary among products to be dispensed and therefore, uniformity of alignment is difficult or impossible to achieve without close attention to such alignment. The instant invention discloses apparatus for dispensing such non-uniformaly aligned packets. The invention comprises one or more magazines arranged within a housing which permits insertion or removal of magazines therefrom independent of the other magazines and which includes a front opening sufficient to permit identification of labeling of the individual magazines as well as access to frontal openings in the magazine. Each magazine comprises a conforming sleeve partly surrounding a product receiving tray having a generally curved element disposed therein engaging the inner rear wall of the tray at one end thereof and comprising a front wall of the tray at the opposite end thereof. The tray enclosing sleeve is closed at one end and open at the opposing end. A cut portion is provided within one wall which extends from and communicates with the open end of said sleeve. The cut portion of said sleeve cooperates with said tray in providing a dispensing opening in the magazine when the sleeve is placed about said tray. An optional shelf is provided depending from the tray at its front wall outward from the opening in the magazine. Optionally provided is a flange extending from the lower edge of the housing. Appropriate wall mounting means may be incorporated as well.

It is a general objective of the invention to provide an improved dispensing receptacle featured by its effectiveness of operation.

It is a further objective of the invention to provide a gravity fed dispenser which may employ a plurality of separate product magazines, each of which may be disposed independently of the others, each of which may be replenished or substituted independently of the others, and each of which may advise the customer effectively of the products contained in the magazines employed.

It is a further objective of the invention to provide a dispensing container with no moving parts which will dispense non-uniformally stacked packets of differing shapes and flatness.

These and other objects and features of the invention will become apparent from the claims and the description which follows.

DESCRIPTION OF THE DRAWINGS

FIG. 1 is a perspective view of the invention.

FIG. 2 is a view in perspective of the invention showing a magazine removed.

FIG. 3 is an exploded view in perspective of a magazine of the invention.

DETAILED DESCRIPTION OF THE INVENTION

Referring to the drawing figures, invention 2 is disclosed in perspective in FIG. 1. Magazines 4 are shown side by side installed in housing 26. Housing 26 is depicted as containing four magazines in the preferred embodiment of FIG. 1. However, housing 26 may be equally suited to carry any other plurality of magazines 4 if suitably sized. Housing 26 is provided with flange 20 which extends from the front wall 33 of housing 26 at its lower edge 30. Flange 20 may alternatively be a plurality of flange like structures. Also provided fixed to the bottom of housing 26 is fastener 18 as seen in FIG. 2. In the preferred embodiment, fastener 18 is double-sided tape but alternate fastening means are also contemplated including Velcro fastener or other adhesives. Because it is contemplated that invention 2 will be typically placed on a store counter, fastener 18 enables the user to retain invention 2 to a horizontal surface such as a store counter.

Though not visible in the figures, a rear wall opening or fastener such as double-sided tape may be provided to enable hanging invention 2 upon a vertical surface.

Housing 26 is provided with opening 34 which enables display of labels 36 while magazine 4 is deployed within housing 26. Additionally, opening 34 of housing 26 provides access to port 24 of magazine 4 from which the user may remove one or more individual packets 38. Opening 34 also is provided to allow shelf 12 of magazine 4 to protrude from port 24. Shelf 12 provides a surface over which the user may exert downward sliding pressure when a user uses a thumb or finger to remove a packet 38.

Packets 38 are contemplated to contain individual dosages of over-the-counter medications such as aspirin tablets, acetaminophen tablets, effervescent or other antacid tablets, and the like, though other materials-containing packets could as well be dispensed from invention 2. Because packets 38 may contain tablets or capsules, they are not anticipated as being uniformly flat but rather are somewhat bumpy, though generally flat. These features of packets 38 necessitate that magazines 4 be sufficiently large such that non-uniform items such as packets 38 may fall generally freely within them.

Magazines 4 comprise sleeve 8 removably mounted about tray member receiving 6 as seen in FIG. 3. Sleeve 8 is featured with closed end 28 and its opposing end 29 open and capable of receiving open portion 44 of tray member 6. Liner 10 is disposed along rear wall 16 of tray member 6 along open portion 44 thereof. Liner 10 is disposed from corner 40 toward the front of tray member 6 to form shelf 12 which extends from front wall 14 of tray member 6. In the preferred embodiment, liner 10 is formed from the wall material extending above front wall 14 which is folded to form shelf 12 and corner 40 and is fastened suitably to rear wall 16 at top end 46 of open portion 44 of tray member 6. Corner 40 may alternatively be less pronounced and may be substituted with a curved section of liner 10 in an alternate embodiment.

Sleeve 8 is sized according to the length of open portion 44 of tray member 6 such that port 24 is formed by the cooperation between shelf 12 of tray member 6 and sleeve 8. Tab 22 is perforatedly cut into sleeve 8 to provide closure of port 24 in transit. Removal of tab 22 is accomplished when dispensing is to begin.

Tray member 6 is appropriately sized such that lower wall 14 is generally equal in height to lower wall section 32 of front wall 33 of housing 26. Because of this appropriate sizing, shelf 12 of magazine 4 is supported at lower edge 35 of opening 34.

OPERATION AND USE OF THE INVENTION

Tray member 6 is loaded with packets 38 at the factory in a generally vertical stack. Sleeve 8 is placed about tray member 6 such that closed end 28 provides stop means for sleeve 8 such that tab 22 engages shelf 12, forming magazines 4 thereby. Magazine 4 holding a supply of packets and marked with label 36 is inserted into top opening 27 of housing 26. Upon setup for use, tab 22 is removed providing port 24. Packets 38 are presented at port 24. Fastener 18 is utilized to mount invention 2 to a suitable horizontal surface. Flange 20 provides stability.

When packets 38 of a given magazine 4 are depleted, that magazine may be removed from housing 26 and sleeve 8 removed to allow replenishment of packets 38 in tray member 6. The sleeve 8 is then remounted over tray member 6 and the resulting magazine 4 is reinstalled in housing 26.

Alternatively, magazine 4 when emptied may be discarded and a substitute filled magazine inserted in housing 26. Should the user determine that more than one magazine 4 of the same contents and label are desired in a housing 26, the novel features of invention 2 allow removal of the undesired magazine and substitution of another therefor.

Having described the invention, I claim:

1. Apparatus for dispensing generally flat articles comprising a housing, a plurality of vertically disposed magazines, said magazines insertable within said housing, each of said magazines being insertable in said housing independent of said other magazines, each of said magazines comprising a sleeve and a tray member, said sleeve and said tray member of each magazine cooperating to provide a port in each of said magazines at the front thereof, each of said magazines having a shelf protruding from the port therein, an opening in said housing providing access to said ports in said magazines, said shelves of said magazines protruding from said opening of said housing, said tray members having an open portion and an adjacent enclosed portion, said shelves of said magazines depending from said tray members at the adjacency of said open portions and said enclosed portions thereof, said sleeves overlay said open portion of said tray members, said sleeves each having a wall and ends, each of said sleeves having an opening in the wall thereof at an end of said sleeve, said opening in said wall of each of said sleeves cooperating with the tray member overlaid by said sleeve to provide said port in said magazine, each of said sleeves being provided with stop means to prevent passage of said sleeve past a predetermined position upon said tray member, said stop means is a closed end of said sleeve,

2. The invention of claim 1 wherein said tray members each have a liner within said open portions thereof, said shelves of said tray members comprise an extension of said liners.

3. The invention of claim 1 wherein said magazines are provided with labels upon the front walls thereof, said opening in said housing provides visible access to the labels of said magazines.

4. The invention of claim 1 wherein said housing is provided with means for mounting said housing upon a supporting structure such that said magazines are generally vertically disposed.

5. The invention of claim 1 wherein said housing is provided with one or more flanges depending generally perpendicularly from the bottom of said housing.

6. The invention of claim 1 wherein said housing is provided with a substantially flat fastener upon the bottom thereof whereby said housing may be fastened to a substantially horizontal surface.

7. The invention of claim 6 wherein said fastener is a strip of double-sided tape.

8. The invention of claim 6 wherein said fastener is a Velcro fastener.

9. Apparatus for dispensing individually packaged non-prescription drugs comprising a housing, a plurality of vertically disposed magazines, said magazines insertable within said housing, each of said magazines being insertable in said housing independent of said other magazines, each of said magazines comprising a sleeve and a tray member, said sleeve and said tray member of each magazines cooperating to provide a port in each of said magazines at the front thereof, each of said magazines having a shelf protruding from the port therein, an opening in said housing providing access to said ports in said magazines, said shelves of said magazines protruding from said opening of said housing, said tray members having an open portion and an adjacent enclosed portion, said shelves of said magazines depending from said tray members at the adjacency of said open portions and said enclosed portions thereof, said sleeves overlay said open portion of said tray members, said sleeves each having a wall and ends, each of said sleeves having an opening in the wall thereof at an end of said sleeve, said opening in said wall of each of said sleeves cooperating with the tray member overlaid by said sleeve to provide said port in said magazine, each of said sleeves being provided with stop means to prevent passage of said sleeve past a predetermined position upon said tray member, said stop means is a closed end of said sleeve.

10. Apparatus for dispensing articles comprising a housing, a plurality of vertically disposed magazines, said magazines insertable within said housing, each of said magazines being insertable in said housing independent of said other magazines, each of said magazines comprising a sleeve and a tray member, said sleeve and said tray member of each magazine cooperating to provide a port in each of said magazines at the front thereof, each of said magazines having a shelf protruding from the port therein, an opening in said housing providing access to said ports in said magazines, said shelves of said magazines protruding from said opening of said housing, said tray members have an open portion and an adjacent enclosed portion, said shelves of said magazines depend from said tray members at the adjacency of said open portions and said enclosed portions thereof, said tray members have a liner within said open portions thereof, said shelves of said tray members comprise an extension of said liners, said liners having a curved portion intermediate thereof, each of said sleeves being provided with a closed end to prevent passage of said sleeve past a predetermined position upon said tray member.

11. The invention of claim 10 wherein said magazines are provided with labels upon the front walls thereof, said opening in said housing provides visible access to the labels of said magazines.

12. The invention of claim 10 wherein said housing is provided with means for mounting said housing upon a supporting structure such that said magazines are generally vertically disposed.

13. The invention of claim 10 wherein said housing is provided with one or more flanges depending generally perpendicularly from the bottom of said housing.

14. The invention of claim 10 wherein said housing is provided with a substantially flat fastener upon the bottom thereof whereby said housing may be fastened to a substantially horizontal surface.

15. The invention of claim 14 wherein said fastener is a strip of double-sided tape.

16. The invention of claim 14 wherein said fastener is a Velcro fastener.

* * * * *